US006759354B1

(12) United States Patent
Smith et al.

(10) Patent No.: US 6,759,354 B1
(45) Date of Patent: Jul. 6, 2004

(54) PRINTABLE SYNTHETIC FABRIC

(75) Inventors: Garnett H. Smith, Gastonia, NC (US); James E. Bruce, Greensboro, NC (US)

(73) Assignee: Intex Corporation, Greensboro, NC (US)

( * ) Notice: Subject to any disclaimer, the term of this patent is extended or adjusted under 35 U.S.C. 154(b) by 99 days.

(21) Appl. No.: 09/941,124

(22) Filed: Aug. 28, 2001

(51) Int. Cl.[7] ..... B32B 27/04; B32B 27/12; B32B 5/02

(52) U.S. Cl. ..... 442/118; 442/170; 442/304; 427/314; 427/359; 8/115.51; 8/922; 8/933; 8/444; 8/478; 8/486; 8/487; 8/638

(58) Field of Search ..... 442/118, 170, 442/304; 427/314, 359; 8/115.51, 922, 933, 444, 478, 486, 487, 638

(56) References Cited

U.S. PATENT DOCUMENTS

| | | | | | |
|---|---|---|---|---|---|
| 3,580,874 | A | | 5/1971 | Nishimura | 260/22 |
| 3,702,752 | A | | 11/1972 | Bent et al. | 8/2.5 |
| 4,078,886 | A | | 3/1978 | DeFago et al. | 8/2.5 A |
| 4,101,273 | A | * | 7/1978 | Matsuba et al. | 8/609 |
| 4,626,257 | A | | 12/1986 | Matsuo et al. | 8/638 |
| 4,680,032 | A | | 7/1987 | Arnott | 8/486 |
| 4,680,034 | A | | 7/1987 | Arnott | 8/481 |
| 4,929,471 | A | * | 5/1990 | Groelinger | 427/173 |
| 5,169,405 | A | | 12/1992 | Hoyt et al. | 8/481 |
| 5,330,540 | A | | 7/1994 | McBride et al. | 8/554 |
| 5,368,611 | A | | 11/1994 | Owenby et al. | 8/444 |
| 5,917,120 | A | | 6/1999 | Rommel et al. | 8/445 |
| 6,034,226 | A | | 3/2000 | Herzig et al. | 534/854 |
| 6,046,120 | A | * | 4/2000 | Rodrigues | 442/173 |

* cited by examiner

*Primary Examiner*—Elizabeth M. Cole
*Assistant Examiner*—Norca L. Torres
(74) *Attorney, Agent, or Firm*—Womble Carlyle Sandridge & Rice, PLLC; Lewis S. Rowell

(57) ABSTRACT

A dyed fabric, and apparel constructed therefrom, that has a high degree of colorfastness and a soft hand, formed by the process comprising the steps of applying dyestuffs directly to a polyester fabric that has been pre-treated with a wicking agent, and fixing the dyestuffs to the fabric by heating the fabric at between about 350 degrees Fahrenheit for between about 90 and 120 seconds, whereby the finished fabric has a crocking index of at least 4.0, and a soft hand.

18 Claims, 1 Drawing Sheet

PRINTABLE SYNTHETIC FABRIC

FIELD OF THE INVENTION

The present invention relates generally to fabrics receptive to printing or dyeing, and, more particularly, to a synthetic-rich fabric with an improved propensity for dye penetration, dye fixation, and a soft hand.

BACKGROUND OF THE INVENTION

Dyeing has been a part of the finishing process for textiles for thousands of years. For both aesthetic and practical reasons, fabrics and apparel crafted therefrom have been subjected to bleaching and coloration processes.

There are a number of dyeing processes currently in practice, depending upon the particular yarns forming the knitted, woven, or non-woven fabrics. For instance, the natural and man-made fibers and filaments have differing affinities for dyestuffs. Further, fabrics may be either piece dyed, tie dyed, or printed. Printing types include conventional roller printing, flat screen, rotary screen printing, digital printing, and heat transfer (sublimation) printing.

As a general rule, the printing of fabrics made from man-made (synthetic) fibers or filaments has been problematic. Synthetic yarns tend to be hydrophobic and therefore hard to print with pigments, as pigments do not penetrate the yarn, but rather are affixed to the surface of the fabric. Synthetic fabrics such as polyester, nylon, and others are dyestuff-specific and may not accept all categories of dyestuffs. Heat transfer printing with disperse dyes has been found acceptable for synthetics and produces a well-defined pattern on the face of the fabric; however, this type of printing requires that disperse dyes be first applied to a paper substrate and then heat transferred to a fabric surface. While the outer printed surface has a satisfactory appearance and sharpness of lines, the disperse dyes do not completely penetrate the yarns forming the fabric, resulting in an undyed inner surface and an unacceptable dyed appearance when the fabric is stretched, due to lack of dye penetration between yarns.

Disperse dyes may be applied directly to a fabric; however, heretofore the resulting product has not had as soft a hand, the level of crocking, or as good a level of colorfastness as disperse dyes applied by the heat transfer method. Further, the disperse dyes have not been compatible with conventional softeners. This is the problem addressed by the present invention; that is, how to obtain a better dye result with disperse dyes applied directly to synthetics.

The end use of an item of apparel dictates the combination of yarn, fabric construction (woven, knitted, etc.), finishing, and dyeing that goes into the item. For example, important characteristics of many items of apparel include softness, firmness, fineness, or other qualities perceived by touch, and the ability of the material to disperse or spread moisture, or wicking. Softness is often the desired quality in apparel. To achieve this quality, particularly in synthetic fabrics, chemical finishes such as softeners are used. Unfortunately, conventional softeners have typically been hydrophobic, that is, lacking an affinity to absorb water, or dyes. This has been particularly true where disperse dyes have been used. For many items of outerwear, particularly work clothing, a high level of wicking is desirable for the comfort of the wearer. Wicking agents are applied to synthetic fabrics to achieve this result.

SUMMARY OF THE INVENTION

The present invention is directed to a synthetic-rich fabric and apparel formed therefrom that has improved dye penetration, colorfastness, and a soft hand not heretofore known in synthetic-rich fabrics where the dye is applied directly to the fabric.

In the preferred embodiment of the present invention, a knitted fabric is formed from 100 percent polyester yarn, although other synthetic-rich yarns are equally suitable. As used herein, "synthetic-rich" means that at least 51% of the yarn is polyester or other suitable synthetic yarns and 49% or less of the yarn is natural.

Any conventional fabric construction may be printed with the present invention, but the preferred embodiment is a knit construction. The knit construction may be single knit, double kit, etc. and there is no limitation on the type of knitting machine that may be used to form the initial knitted fabric. Further, yarns sizes are not critical to the present invention, but spun polyester in counts of 10/1 to 40/1 have been found most suitable. Alternatively, continuous filaments could be used to form yarn constructions having composite deniers between about 40 and 300.

The knitted fabric is initially chemically treated with a wicking agent and heat set. In addition to being hydrophilic, which aids substantially in the penetration of directly applied disperse dyes, the wicking agent used herein produces a secondary benefit of creating some softening in the fabric. Additionally, a hydrophilic softener may be applied to the knitted fabric. Heretofore, softeners have not been used for printed synthetic fabrics because of their hydrophobic characteristics which impede dye fixation, particularly with disperse dyes.

Once chemically treated with the wicking agent (and hydrophilic softener as desired), the treated fabric is ready for the printing process. In the preferred embodiment, rotary screen printing is used, but other printing processes such as immersion and continuous dyeing, flat screen, conventional rollers, or digital could also be used. With the rotary screen printing machine, one or more disperse dyes are used to obtain the desired color pattern. Disperse dyes are a class of water-soluble dyes usually applied from aqueous solutions and known for dyeing synthetic fibers, although only heat transfer printing has yielded satisfactory results. In the present invention, the dyestuffs arc suspended using a commercially available concentrate and applied directly to the fabric by the rotating screens.

Following printing, the printed fabric is subjected to a fixation process using a conventional heat setting machine. The printed fabric is passed through a tenter frame where it is stretched to the desired width with steam and then fixed through propane gas heating at about 350 degrees Fahrenheit for between about 1.5 and 2 minutes. Alternatively, the dye fixation could be accomplished using infrared heating at the same temperature and for the same amount of time.

Once the printed fabric has been heat set, the final product is complete and ready for packaging. It has been found that the combination of disperse dyes and a wicking agent, when applied to a 100 percent knitted polyester fabric, produces unexpected results in the final fabric. That is, the final fabric exhibits both a dry and wet crock of at least 4.0. Additionally, the colorfastness of the finished dyed fabric is excellent, measuring 4 when subjected to the American Association of Textile Chemists and Colorists (AATCC) Test Method 61-1996, "Colorfastness to Laundering, Home and Commercial: Accelerated", which measures colorfastness on a scale of 1 to 5. The final fabric also has a soft hand. As used herein, "hand" refers to that characteristic widely known in the textile industry as the tactile quality of a fabric; e.g., softness, firmness, elasticity, fineness, resiliency, and other qualities perceived by touch. Thus, the final fabric of the present invention exhibits a soft, as opposed to a rough or stiff, hand.

These and other aspects of the present invention will become apparent to those skilled in the art after a reading of the following description of the preferred embodiment when considered with the drawings.

DESCRIPTION OF THE PREFERRED EMBODIMENTS

Figure 1:
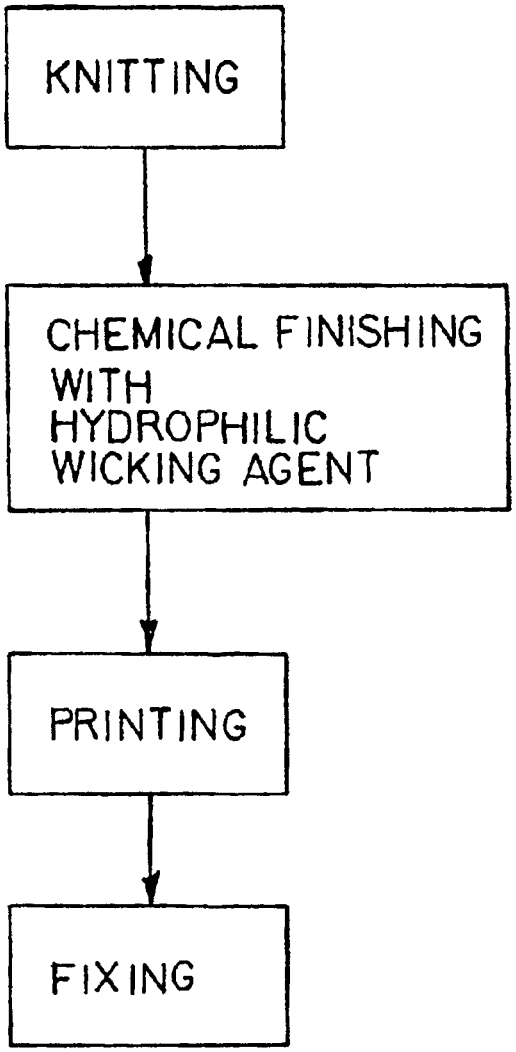
FIG. 1 is a simplified flow diagram of the process for making the printable knitted fabric of the present invention.

Referring now to FIG. 1, it will be understood that the illustration is for the purpose of describing a preferred embodiment of the invention and is not intended to limit the invention thereto. FIG. 1 is a simplified flow diagram of the process for making the printed fabric of the present invention.

In the preferred embodiment, a 100 percent polyester fabric is used to formed the final printed fabric. Preferably, yarn counts between 10/1 and 40/1 are used in the knitting process. The yarn may be air jet spun, ring spun, open end spun, or any combination of these. Alternatively, continuous filament yarn constructions may be used. The fabric may also be formed in any knit construction on either single knit or double knit machines. Alternatively, the fabric may be a woven or non-woven construction.

The fabric is chemically finished with a hydrophilic wicking agent to give the finished fabric the ability to disperse or spread moisture. One suitable wicking agent is known as Hydrowick HP®, available from Hydrotex of Raleigh, N.C. It has also been found that this wicking agent imparts some degree of softness to the finished fabric. Because the wicking agent itself is hydrophilic, it conditions the fabric to be substantially more receptive to disperse dyes applied/printed directly to the fabric. When additional softness of hand is desired, a softener is optionally applied to the pre-treated fabric. Heretofore, softeners have not been used in conjunction with printing because they interfere with the dye fixing to the fabric. This is because softeners have conventionally been hydrophobic, which has been an impediment to dye penetration. The newer softeners have hydrophilic qualities that not only produce a soft hand, but also help make the fabric more receptive to disperse dyes applied or printed directly to the fabric. While several hydrophilic softeners are now available, one softener that provides exceptional results is available as C-Soft WS, manufactured by Caldwell Chemicals of Mint Hill, N.C. Depending upon the particular fabric construction, the pre-treated, unprinted fabric is heatset at a temperature of between about 250 and 380 degrees Fahrenheit for about 30 to 60 seconds. The pre-treated fabric is then ready for printing.

The printing is performed on a rotary screen printing machine, but may also be flat screen printed, rolled in conventional fashion, or digitally printed. The rotary printing machine used to produce the printed fabric is manufactured by Zimmer of Kufstein, Austria. With rotary screen printers, ink is forced from within the roller (screen) through apertures that form a pattern on the roller. Either a single or multiple colors may be used. Disperse dyes are used in this printing process. A lines of suitable disperse dyes available from BASF of Lugwigshafen, Germany include Bafixan Pink FF3B, Bafixan Yellow 3GE, Bafixan Blue 2RL, Bafixan Blue RS, and Bafixan Black BN. While the Bafixan line has other dyestuffs for both polyester and nylon, those listed herein are the only ones found heretofore that are suitable for simple heat fixation. The present invention, however, is not limited to these particular dyestuffs, but rather to disperse dyestuffs suitable for heat fixation on synthetic materials such as polyester and nylon. The dyestuffs are suspended using a concentrate known as Lutexol HIT, available from BASF of Lugwigshafen, Germany. The use of these disperse dyes in combination with a hydrophilic wicking agent facilitates excellent dye penetration throughout the fabric so that both sides of the fabric sheet are printed, while providing a soft hand. This is superior to heat transfer printing where only one side of the fabric is printed, and far exceeds the finished characteristics of fabric that is printed with pigments.

After the disperse dyes have been applied, the dyes are fixed to the fabric by the application of heat. As a first step, steam is applied to the dyed fabric as the fabric is routed through a tenter frame where it is stretched to a desired final width. In the present invention, the tenter frame stretches the dyed fabric to an optimal width of 62 inches. The fabric is then subjected to propane gas beating at approximately 350 degrees Fahrenheit for 1.5 to 2 minutes along a heating tunnel approximately 100 feet long. The heat setting machine used in the present invention is manufactured by Elitex of the Czech Republic. A benefit of this fixation process with disperse dyes is that auxiliary or supplemental binders, and cross-linking agents are not required to achieve the desired level of fixation as compared to pigments. As those skilled in the art will appreciate, other fixation techniques will also produce satisfactory results.

The finished fabric has been tested and found to have a soft hand and a crocking index of at least 4.0 on both the wet and dry index. Additionally, after 100 washings, only minimal color loss is detected. The colorfastness of the finished dyed fabric is 4.0 (excellent) as measured by the American Association of Textile Chemists and Colorists (AATCC) Test Method 61-1996, "Colorfastness to Laundering, Home and Commercial: Accelerated", which measures colorfastness on a scale of 1 to 5. This compares with a colorfastness of 1 to 2 for pigments. This test method evaluates color loss resulting from detergent solutions and abrasive action of five typical hand, home or commercial launderings.

Certain modifications and improvements will occur to those skilled in the art upon a reading of the foregoing description. It should be understood that all such modifications and improvements have been deleted herein for the sake of conciseness and readability but are properly within the scope of the following claims.

We claim:

1. A printed fabric with high dye penetration, high dye fixation, and a soft hand, formed by a process comprising the steps of:

(a) printing disperse dyes on a synthetic-rich fabric, the synthetic-rich fabric having been pre-treated with a wicking agent; and (b) fixing the disperse dyes to the fabric by heating the fabric at about 350 degrees Fahrenheit for between 90 seconds and 120 seconds, wherein the finished dyed fabric has a dry crocking index of at least 4.0 and a soft hand.

2. The fabric of claim 1 wherein the fabric construction is knitted.

3. The fabric of claim 1 wherein the colorfastness of the finished dyed fabric is 4.0 as measured by the AATCC 61-1996 test method.

4. The fabric of claim 1 wherein the disperse dyes are applied by a process selected from the group of processes consisting of rotary screen printing, flat screen printing, and roller printing.

5. The fabric of claim 1 wherein said synthetic-rich fabric contains at least 51% polyester.

6. The fabric of claim 1 wherein the finished dyed fabric has a wet crocking index of at least 4.0.

7. A garment made of a fabric construction that has a high degree of colorfastness and a soft hand, said fabric construction formed by a process comprising the steps of:

(a) printing disperse dyes on a synthetic-rich fabric, the synthetic-rich fabric having been pre-treated with a wicking agent; and (b) fixing the dyestuffs to the fabric by heating the fabric at about 350 degrees Fahrenheit for between 90 seconds and 120 seconds, wherein the finished dyed fabric has a crocking index of at least 4.0 and a soft hand.

8. The garment of claim 7 wherein the fabric construction is knitted.

9. The garment of claim 7 wherein the dyestuffs are applied by a process selected from the group of processes consisting of rotary screen printing, flat screen printing, and roller printing.

10. The garment of claim 7 wherein said synthetic-rich fabric contains at least 51% polyester.

11. The garment of claim 7 wherein the finished dyed fabric has a wet crocking index of at least 4.0.

12. The garment of claim 7 wherein the colorfastness of the finished dyed fabric is 4.0 as measured by the AATCC 61-1996 test method.

13. A method of forming a printed fabric that has a high dye fixation and a soft hand, comprising:

(a) printing disperse dyes on a synthetic-rich fabric, the synthetic-rich fabric having been pre-treated with a wicking agent; and (b) fixing the disperse dyes to the fabric by heating the fabric at about 350 degrees Fahrenheit for between 90 seconds and 120 seconds, wherein the finished dyed fabric has a dry crocking index of at least 4.0 and a soft hand.

14. The method of claim 13 wherein the synthetic-rich fabric is knitted.

15. The fabric of claim 13 wherein the disperse dyes are applied by a process selected from the group of processes consisting of rotary screen printing, flat screen printing, and roller printing.

16. The fabric of claim 13 wherein said synthetic-rich fabric contains at least 51% polyester.

17. The fabric of claim 13 wherein the finished dyed fabric has a wet crocking index of at least 4.0.

18. The fabric of claim 13 wherein the colorfastness of the finished dyed fabric is 4.0 as measured by the AATCC 61-1996 test method.

* * * * *